US010066361B2

(12) United States Patent
Jewell et al.

(10) Patent No.: US 10,066,361 B2
(45) Date of Patent: Sep. 4, 2018

(54) PLOW LIFT AND DOWN PRESSURE CONTROL MECHANISMS, SYSTEMS, AND METHODS

(71) Applicant: 906 Engineering Corporation, Marquette, MI (US)

(72) Inventors: Matthew P. Jewell, Gwinn, MI (US); Peter Carl Menze, Marquette, MI (US); Stephen Robert Lang, Ishpeming, MI (US)

(73) Assignee: 906 ENGINEERING CORP., Marquette, MI (US)

( * ) Notice: Subject to any disclaimer, the term of this patent is extended or adjusted under 35 U.S.C. 154(b) by 0 days.

(21) Appl. No.: 15/482,608

(22) Filed: Apr. 7, 2017

(65) Prior Publication Data

US 2017/0292245 A1 Oct. 12, 2017

Related U.S. Application Data

(60) Provisional application No. 62/319,682, filed on Apr. 7, 2016.

(51) Int. Cl.

| | |
|---|---|
| ***E02F 3/84*** | (2006.01) |
| ***E01H 5/06*** | (2006.01) |
| ***E02F 9/22*** | (2006.01) |

(52) U.S. Cl.

CPC ..... *E02F 3/844* (2013.01); *E01H 5/061* (2013.01); *E02F 9/2235* (2013.01); *E02F 9/2271* (2013.01)

(58) Field of Classification Search

CPC ..... E01H 5/065; E01H 5/063; E01H 5/062; E01H 5/06; E01H 5/061; E02F 3/844; E02F 3/7609; E02F 9/2235; E02F 9/2271; B62D 65/00

USPC ..... 37/197, 231–236, 266

See application file for complete search history.

(56) References Cited

U.S. PATENT DOCUMENTS

| | | | | |
|---|---|---|---|---|
| 5,265,356 | A * | 11/1993 | Winter | E01H 5/06 37/232 |
| 5,832,637 | A * | 11/1998 | Aguado | E01H 5/06 37/234 |
| 5,987,785 | A | 11/1999 | Aguado et al. | |
| 6,640,468 | B2 | 11/2003 | Menze | |
| 7,565,756 | B2 * | 7/2009 | Almadani | E01H 5/06 37/232 |
| 8,793,907 | B2 | 8/2014 | Walimaa et al. | |
| 2013/0318838 | A1 | 12/2013 | Walimaa et al. | |
| 2014/0298690 | A1 | 10/2014 | Walimaa et al. | |

* cited by examiner

*Primary Examiner* — Robert E Pezzuto
(74) *Attorney, Agent, or Firm* — Device Patent LLC

(57) ABSTRACT

A low cost plow lift and down pressure system comprising a lift frame having a lift end and a mount end for securing to a plow vehicle. A lever beam articulates with a lift end of the lift frame. The system further comprises a; lift tension line, down pressure tension line, hydraulic pump, hydraulic cylinder, push frame, down pressure arm, and plow. A push frame extends between a plow and a lift frame. A lift tension line extends between a plow receiver near the plow and a lift receiver on the lever beam. A down pressure tension line extends between a first down pressure receiver on the lever beam to a second down pressure receiver located on a down pressure arm that is coupled to the push frame. Active extension and retraction of a first hydraulic cylinder causes consequent raising of the plow and plow down pressure.

20 Claims, 9 Drawing Sheets

PLOW LIFT AND DOWN PRESSURE CONTROL MECHANISMS, SYSTEMS, AND METHODS

This application claims priority to Provisional Patent Application No. 62/319,682 filed Apr. 7, 2016, the entire disclosure of which is hereby incorporated by reference and relied upon.

BACKGROUND OF THE INVENTION

Field of the Invention

The invention relates generally to snowplow control mechanisms, and more particularly to snowplow lift and down pressure control mechanisms.

Description of Related Art

Plows are utilized throughout the country to remove snow from roads, parking lots, and other terrestrial surfaces needing to be cleared. Plows are also used to grade dirt or gravel roads to keep them smooth. Plows are commonly releasably mounted to the front end of a plow truck. An associated plow truck may be small or large. Commonly pickup or other similar framed vehicles are used. Typically a plow is controlled by hydraulics to lift and lower a plow or to turn it such that it leads with a left or right edge. Some plow systems utilize a complex system of hydraulics to perform these actions and constantly adjust the hydraulics based on the pressures sensed in by a hydraulic system. This approach requires the use of abundant energy usually drained from an associated truck and can cause accelerated wear of the hydraulic system from the repetitive adjustments.

Many plow systems rely on the weight of the plow to keep the plow lowered across the road or terrestrial surface during plowing. More advanced and consequently more expensive plow systems provide not only the inherent weight of the plow but also an additional down pressure on the plow for improved scraping across the plowed surface. The down pressure must be able to react to varying terrain of the surface to be plowed and again must constantly sense and adjust to these variations. Typically these down pressure systems operate utilizing an advanced system of sensors and control systems.

Less expensive plow systems typically use a simpler system of hydraulics driving a one-way hydraulic cylinder against a linkage system. One of the linkages is commonly in the form of a chain that lifts a plow when an associated hydraulic cylinder is extended. Gravity and the weight of the plow account for the plow lowering when the hydraulic pressure to the cylinder is released.

An example of this type of gravity based system from the prior art is illustrated in FIGS. 1-6. Common components include a push frame 1, lever beam 2, a lift frame 3, a plow 34, a lift tension line 4 typically in the form of a chain, and a hydraulic cylinder 5. A lift frame 3 is typically secured to a frame that is bolted the front of a truck frame. As illustrated in FIG. 4, a hydraulic pump coupled with a hydraulic cylinder causes hydraulic cylinder 5 to forcibly extend and pivot lift beam 2 upwards when activated by in cab controls. An attached lift tension line 4 tightens and causes a consequential raising of push frame 1 and plow 34. When the hydraulic pressure is released, gravity pulls plow 18 and push frame 1 down to a float position until resting on the ground causing a slack in the lift tension line as illustrated in FIG. 5. Here the plow follows the contour of the ground as the plow vehicle moves forward. As the plow vehicle moves forward over un-level terrain, the plow continues in a float mode and the lift tension line 4 remains slack. This simple chain lift system has no capability to apply additional down pressure on the plow. This performance deficit results in more snow left on the road after plowing using this system and less effective grating when the plow is used for grating purposes when compared to plow capable of applying down pressure.

What is needed are less expensive robust plow systems that are capable of introducing a down pressure to the plow blade without adding substantial cost to the system.

SUMMARY OF THE INVENTION

Disclosed herein are low cost systems for lifting, lowering, and creating a down pressure on a plow secured to a front or rear end end of plow vehicle.

In one form, a plow lift and down pressure system comprises a mechanical tension line lift mechanism working in cooperation with hydraulics to lift a plow from the ground using a controller operated from inside a plow vehicle.

In one form, a mechanical tension line lift mechanism comprises a lift frame.

In one form, a lift frame is configured with a mount end for securing to the front or rear end of a plow vehicle using a sufficient attachment mechanism such as; sliding and pinning into a plow vehicle's hitch receiver, bolting on a hitch plate, and bolting to the frame of the vehicle.

In one form, a lift frame of a plow lift and down pressure system is releasably attached to a lift frame receiver mounted to a frame of a vehicle such as a pickup truck.

In one form, a lift frame broadens laterally at its mount end.

In one form, an opposing lift end of a lift frame is positioned forward and superiorly on the lift frame in front of a plow vehicle.

In one form, a plow vehicle is in the form of a pickup truck.

In one form, a plow vehicle is in the form of a utility truck.

In one form, a first lift pivot is positioned at a lift end of a lift frame.

In one form, pivotably attached to the first lift pivot is an lever beam extending generally forward a distance towards the plow and backwards towards the plow vehicle.

In one form, located at a forward end of an lever beam is a lift receiver for securing a lift tension line thereto.

In one form, located at a rear end of a lever beam is a down pressure receiver for securing a down pressure tension line thereto.

In one form, a lift receiver and down pressure receiver are situated at opposed ends of an lever beam.

In one form, a second lift pivot is disposed between a lift receiver and a down pressure receiver on an lever beam therein creating a lever arm at each end of the lever beam.

In one form, an lever beam in preferred embodiments is in the form of a U-channel but may assume other profiles.

In one form, a first lift pivot of a lift frame and second lift pivot an lever beam are in the form of holes that are aligned and secured by a pin therethrough around which the lever beam pivots about with respect to the lift frame.

In preferred forms, a plow lift and down pressure system comprises one or more lift tension line and one or more down pressure tension lines that are in the form of a chain.

In an alternative form, one or more of the lift tension line and down pressure tension line is in the form of cable, rope, or other flexible elongate tension device.

In one form, one or more of a lift tension line and a down pressure tension line is slack during various operations of a plow lift and down pressure system.

In one form, an anti-slack member is used in remove slack in one or more of a lift tension line and a down pressure tension line. Examples of suitable anti-slack members include one or more of bungee and other similar rubber, elastic cords, and springs.

In one form, a plow lift and down pressure system comprises a slack pocket within the system to assist in collecting chain or other forms of slack lift or down pressure tension line.

In one form, a plow lift and down pressure system comprises a push frame.

In one form, a push frame comprises a left push strut portion, a right push strut portion, and a base push strut portion generally forming a triangle.

In one form, a push frame is pivotably attached to a lift frame adjacent an inferior base end of the lift frame such that a leading end of the push frame may pivot superiorly and inferiorly for raising and lowering a plow portion coupled to the push frame.

In one form, a leading end of a push frame is attached to a plow wherein forward forces from a plow vehicle are transmitted through a lift frame to a push frame, and to the plow to push snow or other road debris.

In one form, attachment between a plow and a push frame occurs at a pivot junction whereby the plow can be pivotably adjusted (typically by hydraulics) to lead with a left end or be adjusted to lead with a right end or be situated to be generally parallel to a bumper of a plow vehicle.

In one form, a lift boss extends from a pivot junction for securing a lift tension line thereto.

In one form, a lift boss extends from a push frame for securing a lift tension line thereto.

In one form, a plow receiver is disposed on a lift boss for securement of a lower end of a lift tension line.

In one form, an expanding lift member is utilized in the system to provide lifting forces for raising and lowering a plow. In preferred forms, the expanding lift member is in the form of a first hydraulic cylinder driven by changes in hydraulic pressure from a hydraulic pump system.

In one form, a first hydraulic cylinder is pivotably secured at one end to a third lift pivot located at a forward end of an lever beam and pivotably secured at an opposing end to a fourth lift pivot located on a lift frame.

In one form, a first hydraulic cylinder is of a bi-directional variety whereby the first hydraulic cylinder can be controlled to not only actively extend by hydraulic pressure but also to actively retract by hydraulic pressure.

In one form, a fifth lift pivot is positioned at a lower end of a lift frame.

In one form, a down pressure arm comprising a sixth lift pivot is pivotably attached to a lift frame by a pivot pin or bolt extending through a fifth lift pivot on a lift frame and the sixth lift pivot.

In one form, a sixth lift pivot is located between a leading end and trailing end of a down pressure arm.

In one form, secured at a trailing end of a down pressure arm is a first down pressure receiver for securing a lower end of a down pressure tension line thereto.

In one form, a leading end of a down pressure arm is coupled with a push frame.

In one form, coupling between a leading end of a down pressure arm and push frame is in the form of at least one of; opposing contact, pivotably attached, and pivotably and slidingly attached to a portion of a push frame.

In one form, a down pressure arm on a leading end comprises a spring portion and a rigid portion.

In one form, a spring portion of a down pressure arm is in the form of a leaf spring but may assume other spring forms such as a coiled.

In one form, a spring portion of a down pressure arm is of a generally constant rate.

In one form, using a constant rate spring, a user may actuate down pressure to a predetermined stop to preset the downward force.

In one form, the spring rate of a spring portion of a down pressure arm is variable.

In one form, a user toggles or steps down hydraulic pressure to a desired position then adds more downward force as needed.

In one form, a spring portion of a down pressure arm is in the form of a pneumatic or hydraulic spring.

In one form, a down pressure arm is configured to act as a lever. Upward force exerted by a down pressure tension line on a corresponding trailing end of the down pressure arm levers the leading end of the down pressure arm against the push frame causing a consequent downward force to be transmitted to a plow. This causes the associated plow to move across the road or other terrestrial surface with not only the inherent weight of the plow but also with additional downward forces induced through an associated down pressure tension line.

In forms of a down pressure arm comprising a spring portion, resiliency of the spring portion accommodates for variations in the road as the plow vehicle moves forward across the driving surface. Therefore, this mechanism not only applies a relatively constant down pressure on the associated plow, but also prevents plastic deformation to components of the plow by allowing the plow to spring up out of the way should the plow encounter a hard barrier such as a curb at the edge of the road or a rock protruding from the surface of a dirt road.

In one form, a down pressure arm comprises a pusher portion for pushing against a push frame. The pusher portion in one embodiment is in the form of a compression surface at a forward end of a down pressure arm. In other forms the pusher may be in the form of a roller or pad or functionally equivalent part.

In one form, a down pressure arm may be pivoted up into a storage position when down pressure is not being used during plowing operations to prevent unnecessary engagement between one or more of a push frame, portions of pusher, and a down pressure arm. This separation also assists with the reduction of noise and un-necessary wear between the parts. A pin, elastic cord, or other functionally equivalent device may be used to hold the down pressure arm in the storage position until needed.

In one form, a pusher portion of a down pressure arm acts surface to surface against a push frame. The pusher may include a bumper or pad between the contacting surfaces. For example, a down pressure arm may act directly to push down from a top surface of a push frame. Alternatively, a down pressure arm may be fastened to a side or lower surface of a push frame effectively pulling the push frame downwards.

In one form, a pusher portion is pinned to a push frame providing a pusher the freedom to pivot about a single axis. A polymer sleeve may be used between articulating parts.

In one form, a pusher portion is secured to the down pressure arm with a slide pivot joint wherein the pusher may both slide and pivot with respect to the push frame as the push frame adjusts to varying terrain and user initiated plow adjustments. These alternative connections therebetween will also reduce noise such as rattling between the parts.

In one form, a plow lift and down pressure system comprises a plow stand.

In one form, a plow stand is in the form of parking leg. In a storage configuration, a parking leg is folded up against and locked adjacent an associated down pressure arm out of the way from terrain, snow, ice, or other item that may catch on it. In an operable configuration, the leg is rotated down wherein an inferior rest surface is used to rest against pavement or other ground surface. In some forms the plow stand is adjustable in height. The plow stand is useful during attachment and removal of the plow assembly from the truck. With the stand in an operable configuration, the plow may be lowered until the weight of the plow system fully rests on the blade of the plow and the inferior rest surface of the leg. In preferred forms, a plow stand stand is at a height wherein the weight of the plow system is fully unloaded from the associated plow vehicle. The plow system is released from the front end of the plow vehicle and the vehicle can back away from the plow system with minimal friction between a mount end of a lift frame and the plow receiver on the plow vehicle.

In an alternative form, a plow lift and down pressure system comprises a secondary hydraulic cylinder attached between a seventh lift pivot on a lift frame and first down pressure receiver on a down pressure arm. In this embodiment, a first hydraulic cylinder and a second hydraulic cylinder cooperate wherein the first hydraulic cylinder extends to raise the associated plow while the second hydraulic cylinder is generally deactivated in a plow lift mode, and a second hydraulic cylinder extends to increase plow down pressure while the first hydraulic cylinder is generally deactivated in a plow down pressure mode.

In one form, a plow lift and down pressure system utilizes a rigid down pressure arm.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF SELECTED EMBODIMENTS OF THE INVENTION

Embodiments of the invention will now be described with reference to the Figures, wherein like numerals reflect like elements throughout the several views. Various embodiments are distinguished by a letter complementing each numeral. The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

A preferred embodiment of one embodiment of a plow lift and down pressure system is illustrated in FIGS. 7-23. A plow lift and down pressure system 14A (FIG. 9) is illustrated operating in cooperation with a system of hydraulics to lift a plow 34A from the ground. A control interface 91A operated by a user from inside a plow vehicle is electrically coupled to a controller 92A which controls operation of a hydraulic pump 94A secured within a plow vehicle or on a component of the plow lift and down pressure system 14A. The hydraulic pump 94A creates hydraulic pressure that is transferred through one or more hydraulic lines 96A for operation of the system's first hydraulic cylinder 5A.

A plow lift and down pressure system 14A comprises a lift frame 3A. Lift frame 3A is configured with a mount end 24A for securing to the front end or front under frame of a plow vehicle using a sufficient attachment mechanism such as; sliding and pinning into a hitch receiver, bolting on a hitch plate, or bolting to the frame of a plow vehicle. In some forms lift frame 3A is releasably attached to a lift frame receiver mounted to the frame of a vehicle such as a pickup truck. In some forms lift frame 3A may broaden laterally at its mount end 24A.

Figure 10:
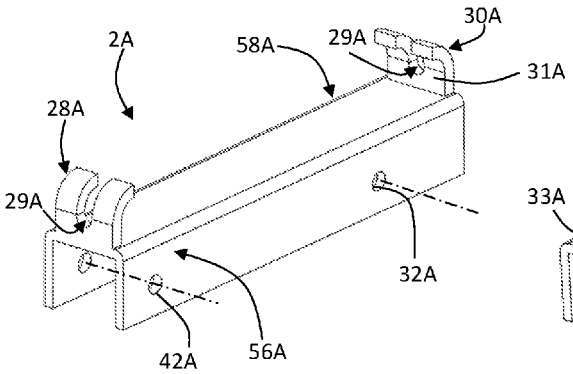
FIG. 10 is a perspective view of one embodiment of an lever beam and associated down pressure receiver and lift receiver.
Figure 11:
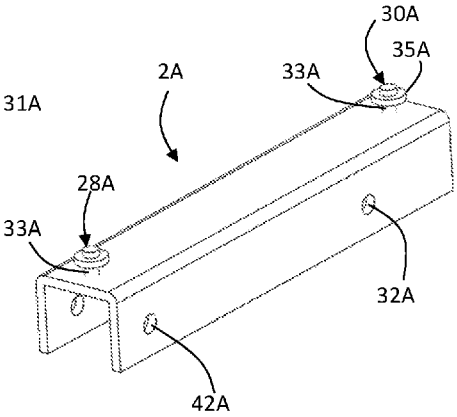
FIG. 11 is a perspective view of one embodiment of an lever beam and an alternative down pressure receiver and lift receiver.

An opposing lift end 22A of lift frame 3A extends forward then superiorly in front of a plow vehicle. In some forms a lift frame 3A is in the general shape of an 'L'. A first lift pivot 26A is positioned at the lift end 22A of lift frame 3A. In preferred forms, lift pivots are in the form of aligned holes through parts. Lift pivots are used for pivoting between adjacent parts when a pivot member (not shown) such as a bolt or pin is extended therethrough. Pivotably attached at first lift pivot 26A of lift frame 3A is a lever beam 2A by aligning and pinning first lift pivot 26A with second lift pivot 32A of lever beam 2A. Lever beam 2A extends generally forward from second lift pivot 32A a distance towards a plow 34A and backwards towards a plow vehicle creating a lever arm on opposing sides of second lift pivot 32A. Located at a forward end 56A of lever beam 2A is a lift receiver 28A for securing a lift tension line 4A thereto (FIG. 10, 11). Located at a rear end 58A of lever beam 2A is a first down pressure receiver 30A for securing a down pressure tension line 7A thereto. Lift receiver 28A and first down pressure receiver 30A are situated at opposed ends of lever beam 2A with second lift pivot 32A disposed therebetween. Lift receiver 28A and first down pressure receiver 30A are configured for securement of lift and down pressure tensions lines 4A, 7A. As just two examples, lift receiver 28A and first down pressure receiver 30A may be in the form of a curved U-shaped finger having a capture slot 29A to capture a chain link against a capture surface 31A as illustrated in FIG. 10. Alternatively as another example, lift receivers may be in the form of capture posts that tighten through the chain link as illustrated in FIG. 11. The capture posts 33A may comprise a capture shoulder 35A to prevent a chain link from slipping off. Lever beam 2A in preferred embodiments is in the form of a U-channel but may assume other profiles. In preferred embodiments, a lift end 22A of lift frame 3A and a push arm 60A of a first hydraulic cylinder 5A extend inside of the U where lift pivots from each part are aligned and secured with a pin (not shown). Pins utilized within a plow lift and down pressure system may be in the form of a bolt or other locking style pin or functionally equivalent device. First lift pivot 26A and second lift pivot 32A may be in the form of holes that are aligned and secured by a pin therethrough (not shown) around which the lever beam 2A pivots about with respect to the lift frame 3A.

Figure 1:
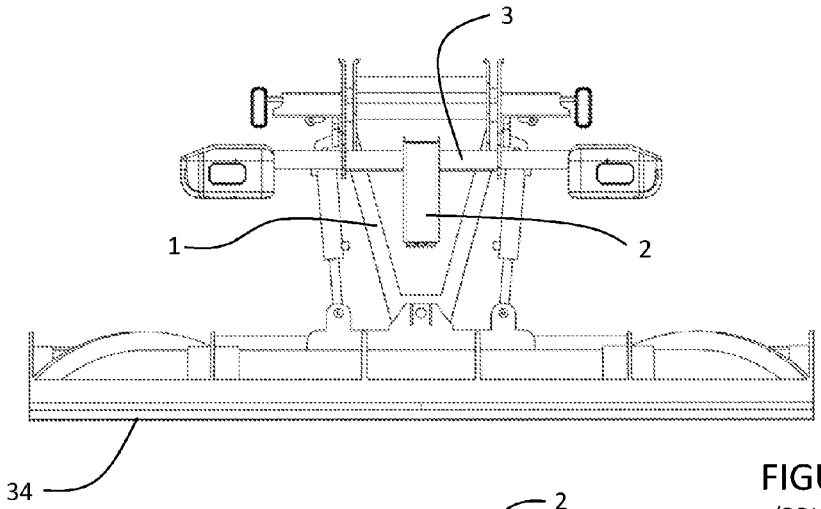
FIGURE 1 (PRIOR ART)
FIG. 1 is top view of a plow system of the prior art with lift tension chains removed.
Figure 2:
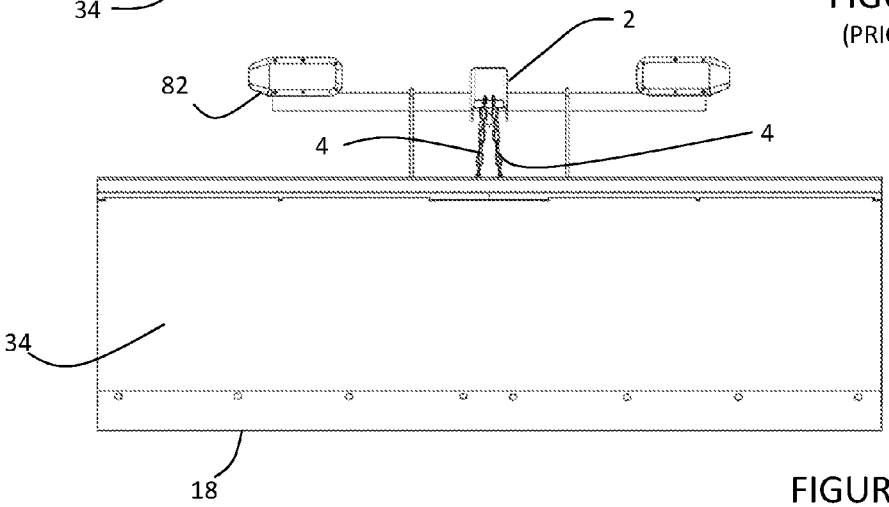
FIGURE 2 (PRIOR ART)
FIG. 2 is a front view of a plow system of the prior art utilizing lift tension lines in the form of chains.
Figure 3:
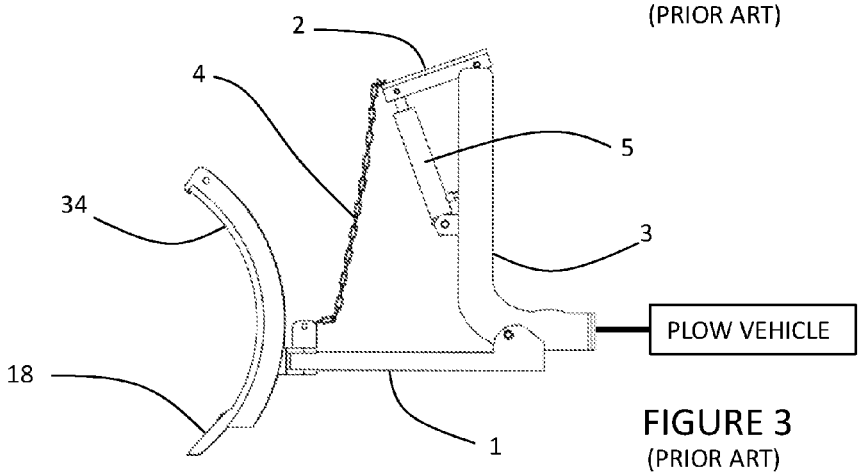
FIGURE 3 (PRIOR ART)
FIG. 3 is a side view of a plow system secured to a plow vehicle of the prior art using a one way hydraulic cylinder with chain to elevate a plow.
Figure 4:
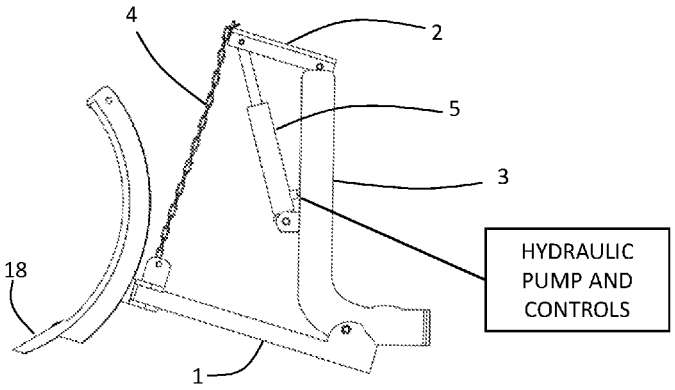
FIGURE 4 (PRIOR ART)
FIG. 4 is a side view of a plow system of the prior art illustrating a hydraulic pump causing a one-way hydraulic cylinder to extend causing consequent lifting of a plow by a lift tension line.
Figure 5:
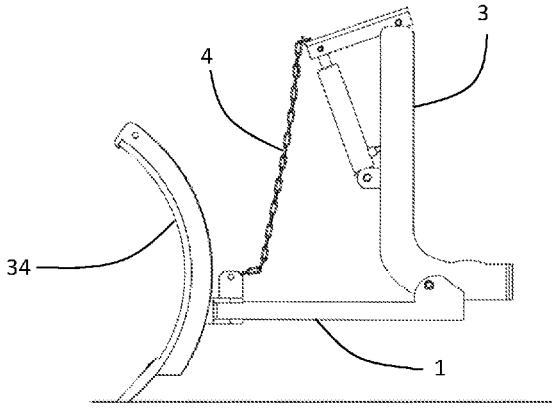
FIGURE 5 (PRIOR ART)
FIG. 5 is a side view of the plow system of FIG. 4 of the prior art illustrating a deactivated hydraulic cylinder wherein gravity pulls a plow down to a road surface.
Figure 6:
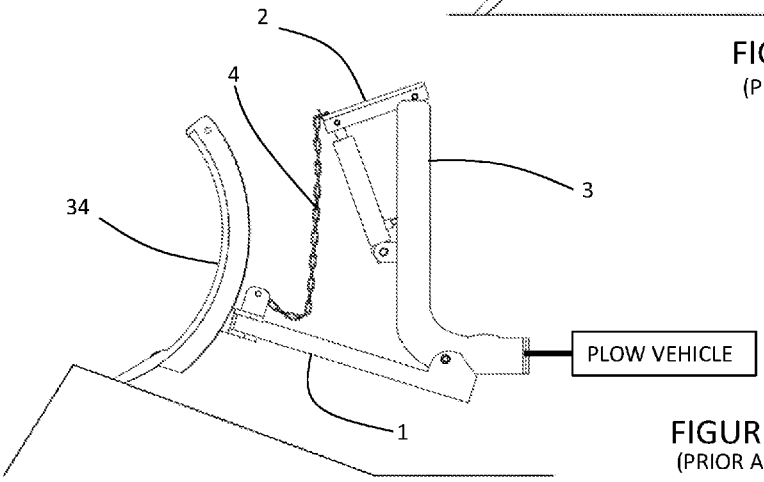
FIGURE 6 (PRIOR ART)
FIG. 6 is a side view of the plow system of FIG. 4 of the prior art illustrating a deactivated hydraulic cylinder wherein the plow moves across an elevated surface.
Figure 7:
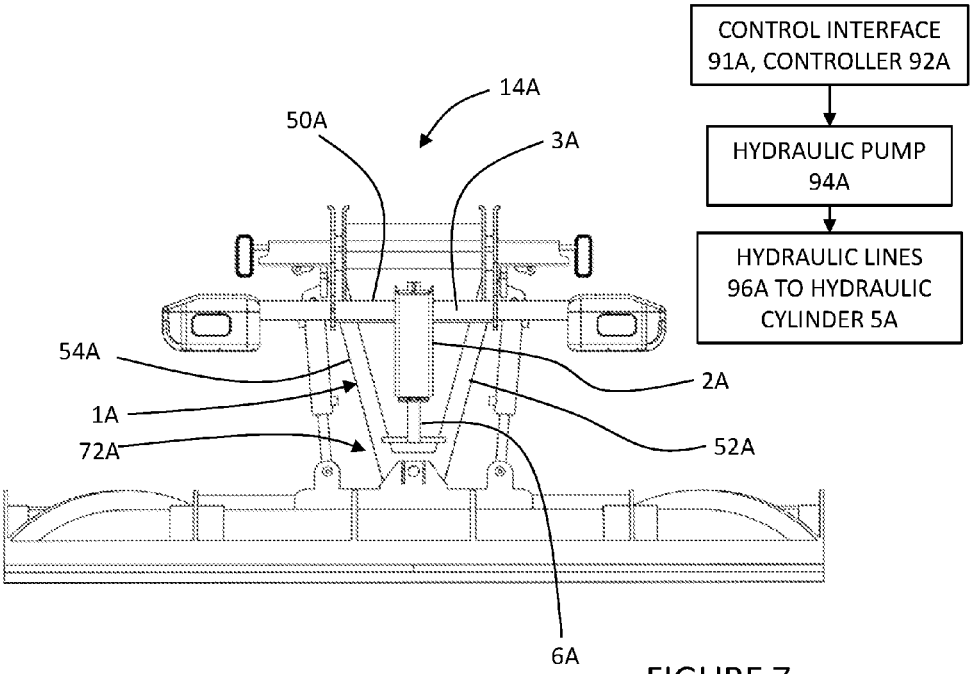
FIG. 7 is a top view of one embodiment of a plow lift and down pressure system of the instant invention with lift and down pressure tension lines removed.
Figure 8:
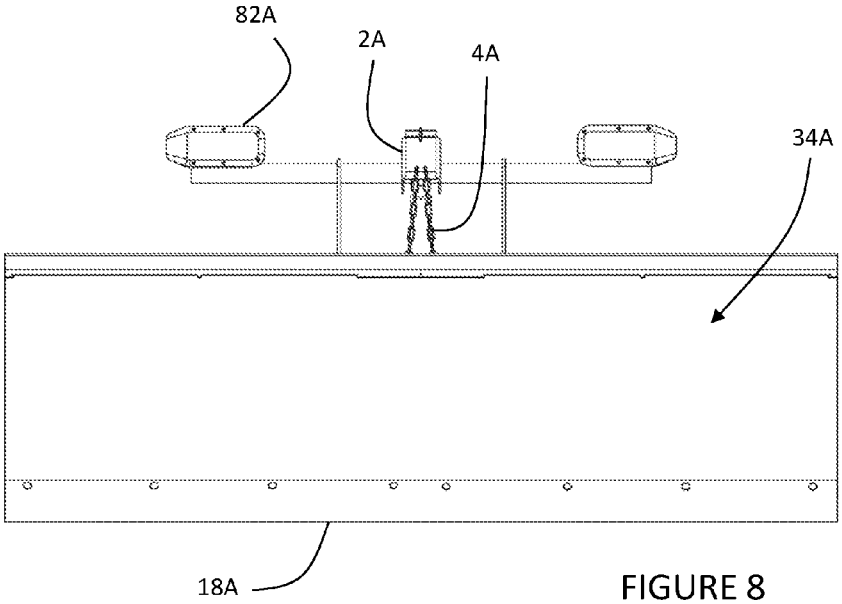
FIG. 8 is a front view of the plow lift and down pressure system of FIG. 7.
Figure 9:
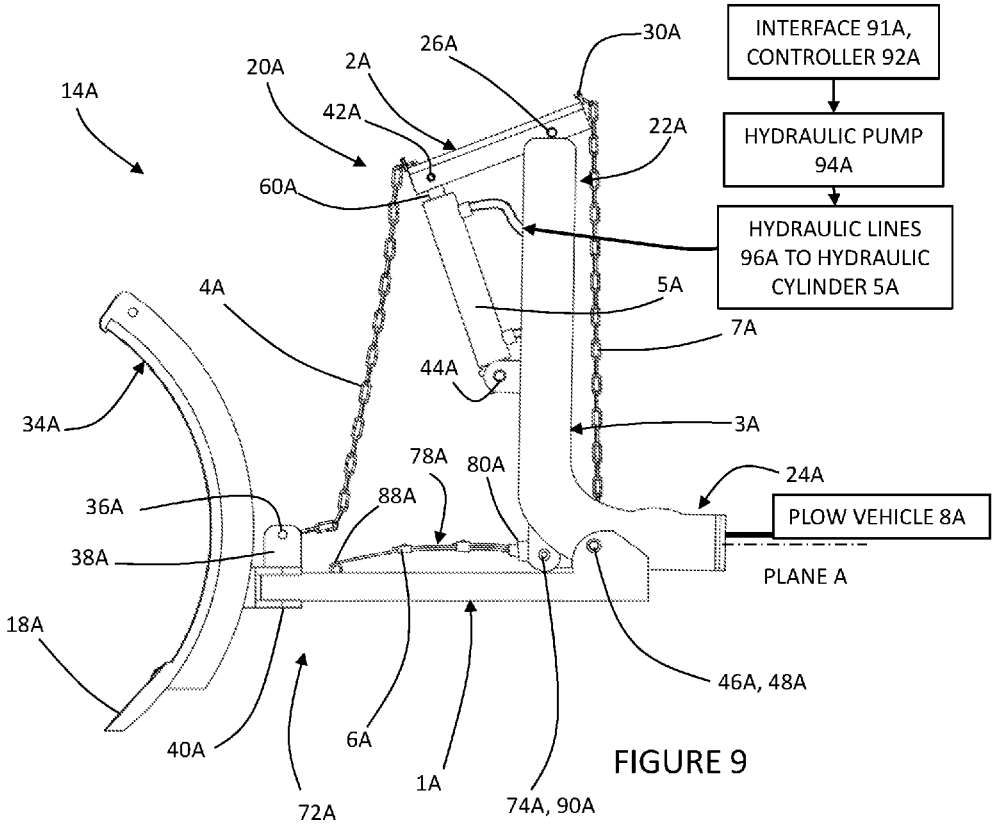
FIG. 9 is a side view of the plow lift and down pressure system of FIG. 7.

As illustrated in FIG. 9, lift and down pressure tension lines 4A(lift), 7A(down pressure) are in the form of a chain in this embodiment. In other embodiments, the tension lines 4A, 7A may be in the form of cable, rope or other functionally equivalent flexible elongate tension devices. Plow lift and down pressure system 14A comprises a push frame 1A. In preferred forms push frame 1A comprises a left push strut portion 52A, a right push strut portion 54A, and a base push strut 50A portion generally forming a triangle (FIG. 7). Each strut portion is secured to the other generally forming an A-frame. In this embodiment, push frame 1A is pivotably pinned on a left and right side to lift frame 3A through aligned lift pivots extending through each component. For example, fifth lift pivot 46A located adjacent base push strut 50A and a sixth lift pivot 48A near an inferior end of lift frame 3A are aligned whereby a leading end 72A of push frame 1A can pivot superiorly and inferiorly for raising and lowering plow 34A. Leading end 72A of push frame 1A is attached to plow 34A wherein forward forces from the plow vehicle are transmitted through lift frame 3A, to push frame 1A, and to plow 34A to push snow or other road debris.

In preferred forms, attachment between plow 34A and push frame 1A occurs at a pivot junction 40A whereby plow 34A can be pivotably adjusted (typically by hydraulics) to lead with a left end of the plow or be adjusted to lead with a right end of the plow or be situated to be generally parallel to the bumper of plow vehicle 8A. At this pivot junction 40A extends a lift boss 38A. A plow receiver 36A is disposed on the lift boss 38A for securement of a lower end of lift tension line 4A. Plow receiver may assume a wide variety of forms known in the art including for example a bolt, a hook, or weld to fix lift tension line to it.

An expanding lift member is utilized in the system to provide lifting forces for raising and lowering the plow. In preferred forms, the expanding lift member is in the form of a first hydraulic cylinder 5A driven by changes in hydraulic pressure from a hydraulic pump system 94A coupled by hydraulic lines 96A and controlled by a controller 92A. First hydraulic cylinder 5A is pivotably secured at one end to a third lift pivot 42A (FIG. 10) located at a forward end of the lever beam 2A, and pivotably secured at the other end to a fourth lift pivot 44A located on the lift frame 3A. First hydraulic cylinder 5A in this embodiment is of a bi-directional variety whereby it can be controlled to not only actively extend by hydraulic pressure but also to actively retract by hydraulic pressure.

A fifth lift pivot 46A is positioned at a lower end of lift frame 3A. The rear of push frame 1A comprises a sixth lift pivot 48A. Push frame 1A is pivotably attached to lift frame 3A by a pivot pin extending between a fifth and sixth lift pivot 46A, 48A on both the left and right side. A seventh lift pivot 74A is located between a leading end and trailing end of down pressure arm 6A and an ninth lift pivot 90A resides at a lower frontal side of lift frame 3A (FIG. 9). Down pressure arm 6A is pivotably attached to lift frame 3A by pivot pin extending between seventh lift pivot 74A of the down pressure arm and ninth lift pivot 90A of lift frame 3A.

At a trailing end of down pressure arm 6A is a second down pressure receiver 76A (FIG. 15, 17) for securing a lower end of down pressure tension line 7A thereto. A leading end of down pressure arm 6A in this embodiment has face to face contact with an upper surface of push frame 1A. Other interfaces such as a pivot or pivot-slide connection may also be used.

As illustrated in FIG. 9, a leading end of down pressure arm 6A comprises a spring portion 78A and a rigid portion 80A on a trailing end. In preferred forms, spring portion 78A is in the form of a leaf spring but may assume other spring forms such as a coiled spring. It is preferred that spring portion 78A is of a generally constant rate but may alternatively be of a variable rate variety.

Down pressure arm 6A in this embodiment is configured to act as a lever. Upward force exerted by down pressure tension line 7A on a trailing end of down pressure arm 6A levers the leading end of the down pressure arm 6A against the push frame 1A. A downward force is then transmitted to the plow 34A. This causes plow 34A to move across a road or terrestrial surface with not only the inherent weight of the plow but also with additional downward forces induced through down pressure tension line 7A from action of first hydraulic cylinder 5A.

Resiliency of spring portion 78A of down pressure arm 6A accommodates for variations in a road surface as a plow vehicle moves forward across the driving surface. Therefore, this mechanism not only applies a relatively constant down pressure on plow 34A, but also prevents plastic deformation to components of the plow by providing for plow 34A to spring up out of the way should the plow encounter a hard barrier such as a curb at the edge of the road or a rock protruding from the surface of a dirt road.

Figure 21:
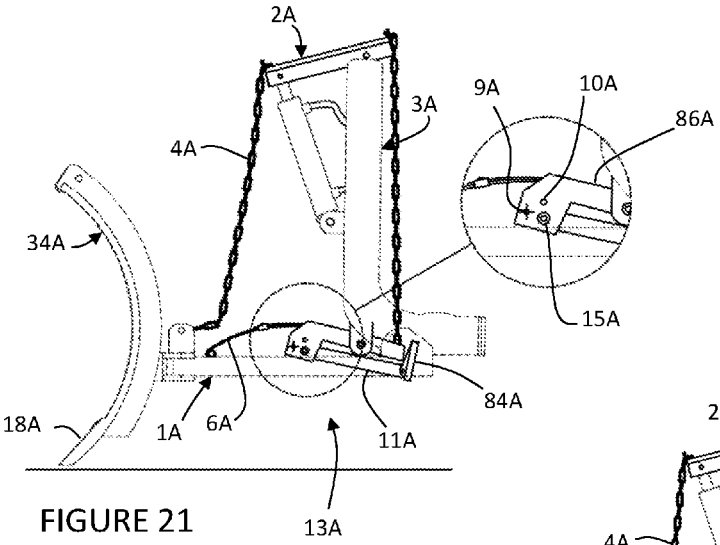
FIG. 21 is a side view of one embodiment of a plow lift and down pressure system comprising a parking leg in a storage configuration.
Figure 22:
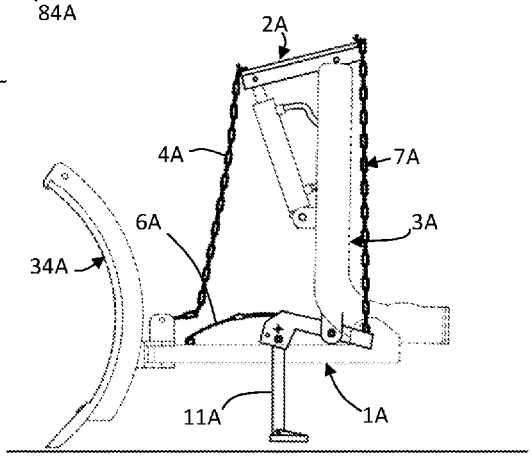
FIG. 22 is a side view of the plow lift and down pressure system of FIG. 21 with a parking leg in an operable configuration.
Figure 23:
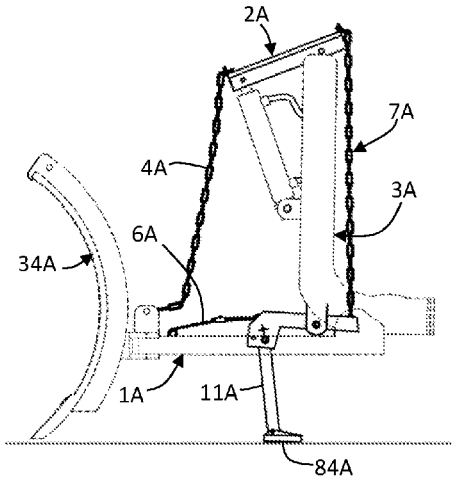
FIG. 23 is a side view of the plow lift and down pressure system of FIG. 21 with a parking leg in operable configuration and a first hydraulic cylinder in an actively retracted orientation for parking the plow lift and down pressure system for quick mounting and dismount from a plow vehicle.

In some embodiments plow lift and down pressure system 14A comprises a plow stand 13A. In preferred forms plow stand 13A is in the form of parking leg 11A as illustrated in FIGS. 21, 22, and 23. In a storage configuration, parking leg 11A is folded adjacent down pressure arm 6A out of the way from terrain, snow, ice, or other items that may catch on it during plowing. In an operable configuration, parking leg 11A is rotated down wherein an inferior rest surface 84A is used to rest against pavement or other ground surface. In some forms, plow stand 13A is adjustable in height. In this embodiment, parking leg 11A pivots from stand body 86A about stand pivot 15A. A stand pin (not shown) occupies operable hole 10A to lock parking leg 11A in an operable extended configuration. A parking leg pin occupies storage hole 9A to lock parking leg 11A in a storage configuration. Plow stand 13A is useful during attachment and removal of a plow lift and down pressure system 14A from a plow vehicle. With parking leg 11A in an operable configuration, plow 34A may be lowered until the weight of plow lift and down pressure system 14A fully rests on blade 18A of plow 34A and inferior rest surface 84A of parking leg 11A. In preferred forms plow stand 13A is at a height wherein the weight of a plow lift and down pressure system 14A is fully unloaded from a corresponding plow vehicle. The plow lift and down pressure system 14A is released from the front end of the plow vehicle 8A and the plow vehicle can back away from the system with minimal friction between the plow lift and down pressure system and plow vehicle. FIG. 22 illustrates a parking leg 11A moved from a storage configuration (retracted) to an operable configuration (extended) however still elevated from the ground surface. The down pressure hydraulics are then activated causing down pressure arm 6A to be loaded (FIG. 23) and simultaneously lowering inferior rest surface 84A to the ground. The plow lift and down pressure system 14A is now balanced on the blade 18A and inferior rest surface 84A. The plow vehicle 8A can now back away to detach from the plow lift and down pressure system 14A.

Figure 12:
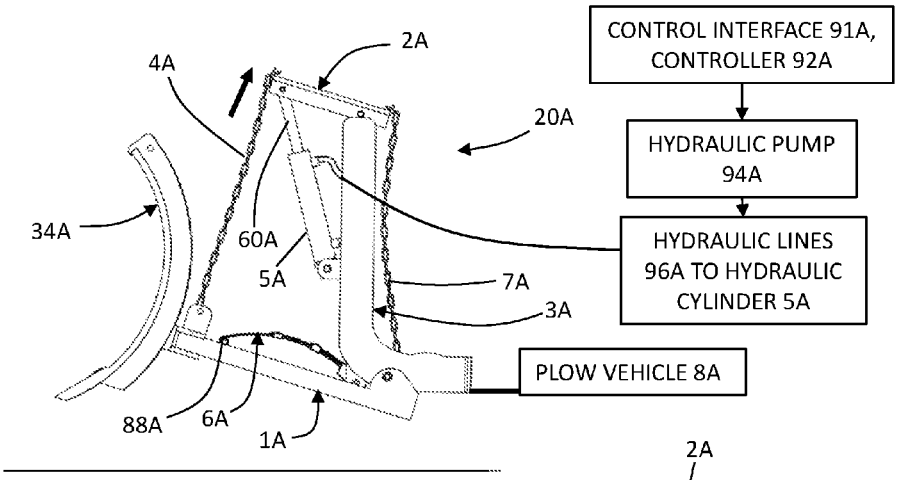
FIG. 12 is a side view of the plow lift and down pressure system of FIG. 7 illustrating first hydraulic cylinder extended causing consequent elevation of a plow.
Figure 13:
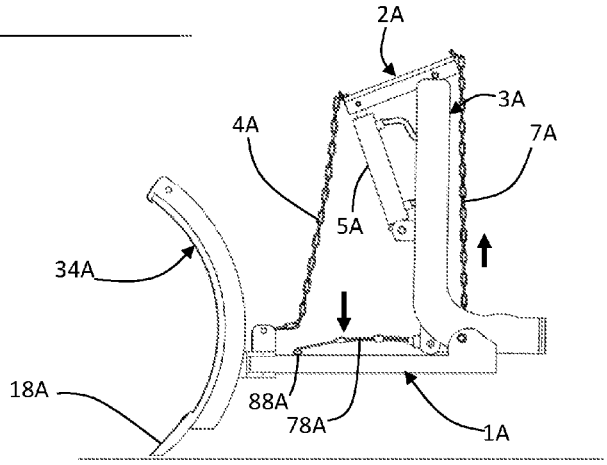
FIG. 13 is a side view of the plow lift and down pressure system of FIG. 7 illustrating a first hydraulic cylinder in an actively retracted orientation causing a down pressure tension line to create plow down pressure.
Figure 14:
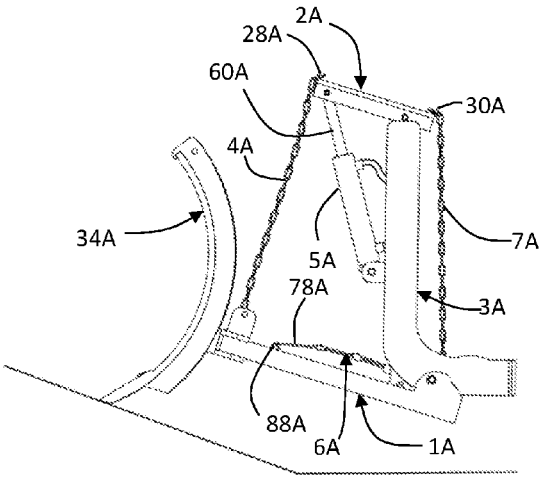
FIG. 14 is a side view of the plow lift and down pressure system of FIG. 7 illustrating first hydraulic cylinder in a float mode wherein a plow portion responds to changes in terrain by elevating and lower by gravity.

FIGS. 12-14 illustrates one method of operation a plow lift and down pressure system 14A. To raise plow 34A, a control interface 91A operated by a user inside a plow vehicle and electrically coupled with a controller 92A activates a hydraulic pump 94A to extend hydraulic pressure through hydraulic lines 96A to first hydraulic cylinder 5A. Through the lift pivots, push arm 60A pushes lever beam 2A upwards thereby tensioning lift tension line 4A. This action leads to lifting of plow 34A and push frame 1A. To lower plow 34A, a user activates a control interface in electrical communication with controller 92A thereby causing the release of hydraulic pressure from hydraulic pump 94A and with consequent pressure loss in first hydraulic cylinder 5A. The weight of plow 34A soon overcomes the hydraulic pressure in first hydraulic cylinder 5A causing push arm 60A to passively retract into first hydraulic cylinder 5A. Plow 34A lowers to the ground. A control interface 91A in this embodiment may comprise one or more of control buttons, joystick, screen, and other typically finger operated or voice operated user control interface mechanisms. In preferred forms, a control interface 91A is located in the cab of a plow vehicle however may alternatively be located outside the cab in other embodiments.

In this embodiment, a method of operation to cause consequent down pressure in plow 34A comprises the following steps. Using a control interface 91A, a user activates a controller 92A causing a hydraulic pump 94A to activate first hydraulic cylinder 5A into forced retraction (FIG. 13). As a coincidence of this, lever beam 2A is forced into a downward pivot thereby elevating the rear end of lever beam 2A thereby causing consequent tension in down pressure tension line 7A and an upward force on second down pressure receiver 76A. This force causes a rotation and loading of down pressure arm 6A (about seventh and ninth lift pivots 74A, 90A) and transmittal of forces through pusher 88A onto push frame 1A. These downward forces extend through to plow 34A forcing plow blade 18A against the ground. As illustrated in FIG. 13, leaf spring portion 78A flattens as potential spring energy is stored in the spring portion 78A.

Illustrated in FIG. 14, is a method of operation of a plow lift and down pressure system 14A in a float mode. The method is activated by a user activating a control interface 91 electrically coupled to controller 92A suspending operation of hydraulic pump 94A and releasing hydraulic pressure in hydraulic lines 96A coupled to first hydraulic cylinder 5A. The release of hydraulic pressure consequently allows push arm 60A to move freely (float) within first hydraulic cylinder 5A. When plow 34A encounters an upward incline or obstacle, push frame 1A pushes against pusher 88A thereby loading down pressure arm 6A and spring portion 78A causing consequential pivoting of down pressure arm 6A. Down pressure tension line 7A consequently tightens as a result and pulls on first down pressure receiver 30A to rotate lever beam 2A wherein push arm 60A extends from first hydraulic cylinder 5A as illustrated in the Figure. Similarly, when plow 34A encounters a downward decline, push frame 1A falls with gravity causing consequent tightening of lift tension line 4A. This action causes lever beam 2A to move downward causing consequent free retraction of push arm 60A into first hydraulic cylinder 5A.

Figure 15:
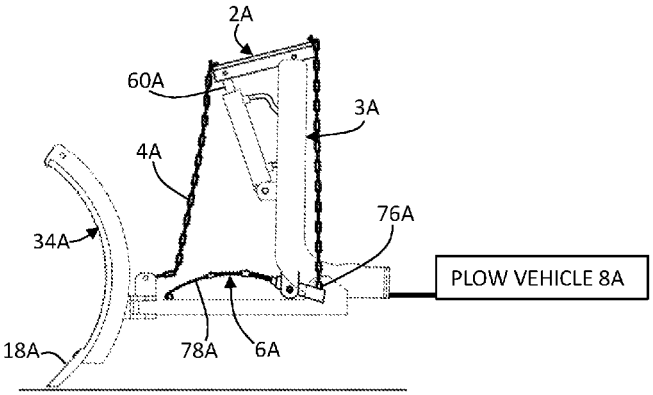
FIG. 15 is a side view of the plow lift and down pressure system of FIG. 7 illustrating first hydraulic cylinder in a float mode wherein a spring portion of a down pressure arm is in an unloaded state.
Figure 16:
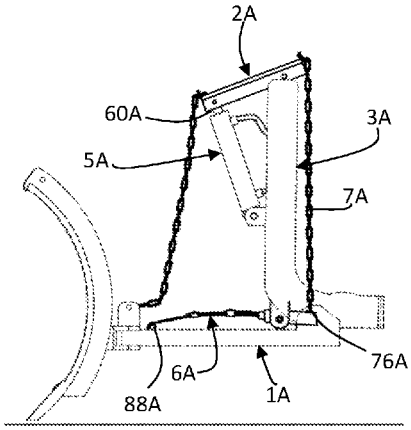
FIG. 16 is a side view of the plow lift and down pressure system of FIG. 7 illustrating a first hydraulic cylinder in an actively retracted orientation wherein a spring portion of a down pressure arm is in a loaded state.

Loading of spring portion 78A is further illustrated in FIG. 15. In this configuration, first hydraulic cylinder 5A is illustrated in a float mode (no hydraulic pressure). Plow 34A is resting on the ground by force of gravity. Lift tension line 4A is slack and spring portion 78A unloaded as evidenced by its tightly curved shape. FIG. 16 illustrates plow lift and down pressure system 14A when a user uses control interface 91A coupled to a controller 92A to activate down pressure. Hydraulic pump 94A pressure through hydraulic lines 96A causes push arm 60A to actively recede into first hydraulic cylinder 5A. This action cause consequent rotation of lever beam 2A and tightening of down pressure tension line 7A thereby pulling up on the second down pressure receiver 76A. Down pressure arm 6A is rotated such that pusher 88A applies a down pressure force onto push frame 1A and consequently into plow 34A and plow blade 18A. Note that spring portion 78A flattens as loading forces are introduced in this step.

Figure 17:
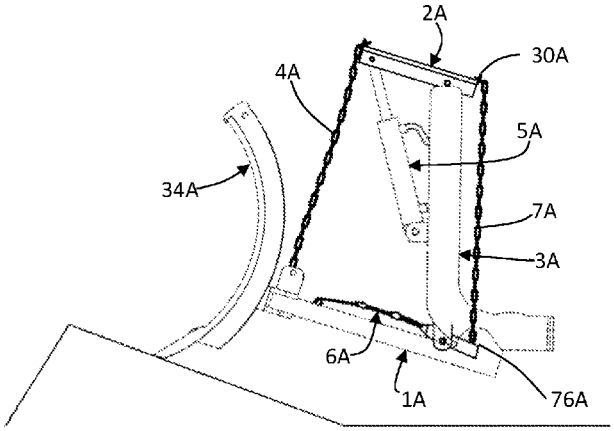
FIG. 17 is a side view of the plow lift and down pressure system of FIG. 7 illustrating a first hydraulic cylinder in a float mode with a plow encountering an elevated terrain.

FIG. 17 illustrates the reaction of the plow lift and down pressure system 14A when the system is in a float mode wherein hydraulic pressure within first hydraulic cylinder 5A is released. In the event the floating plow 34A encounters a rise as illustrated in FIG. 17, plow 34A pushes push frame 1A upward with a consequential downward motion of first down pressure receiver 30A. This motion tensions down pressure tension line 7A thus advancing first down pressure receiver 30A downward and rotating lift receiver 28A upward extending push arm 60A from first hydraulic cylinder 5A. Slack in lift tension line 4A is removed as plow 34A elevates.

Figure 18:
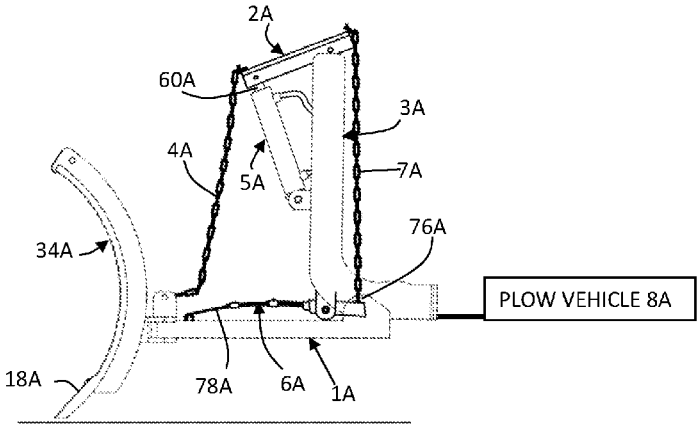
FIG. 18 is a side view of the plow lift and down pressure system of FIG. 7 moving over level terrain and illustrating a first hydraulic cylinder in an actively retracted orientation and wherein a spring portion of a down pressure arm is actively loaded.
Figure 19:
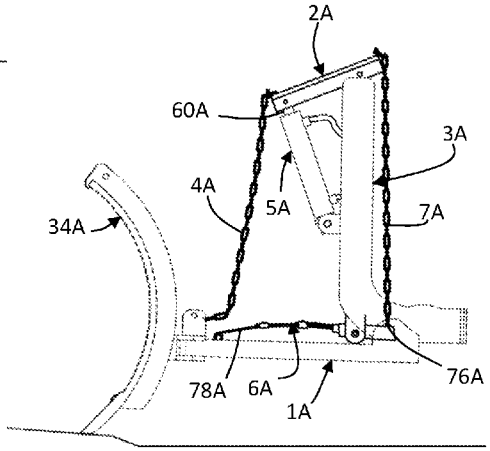
FIG. 19 is a side view of the plow lift and down pressure system of FIG. 18 responding to terrain.
Figure 20:
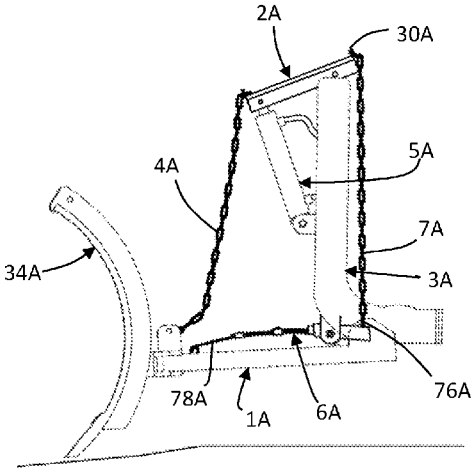
FIG. 20 is a side view of the plow lift and down pressure system of FIG. 18 responding to depressed terrain.

FIGS. 18, 19, and 20 illustrate one embodiment of a plow lift and down pressure system 14A as it responds to various terrains in a down pressure mode. It should be noted that unlike the prior art, the system is absent of plow height sensors, hydraulic pressure monitoring, or other sensors although they may be used. FIG. 18 illustrates the plow lift and down pressure system 14A with push arm 60A actively receded in first hydraulic cylinder 5A through hydraulic pressure created from a hydraulic pump 94A. As a plow vehicle 8A moves forward, a rise in terrain causes an elevation of plow 34A and consequent elevation of push frame 1A as illustrated in FIG. 19. The push frame 1A elevates against pusher 88A further loading spring portion 78A. As the terrain continues to change such as when plow 34A encounters a depression in the plowed surface, spring portion 78A loads and unloads as the push frame raises and lowers over the changing terrain. This is further illustrated in FIG. 20 as the tensioned spring adjusts to accommodate a dip in the terrain.

Figure 24:
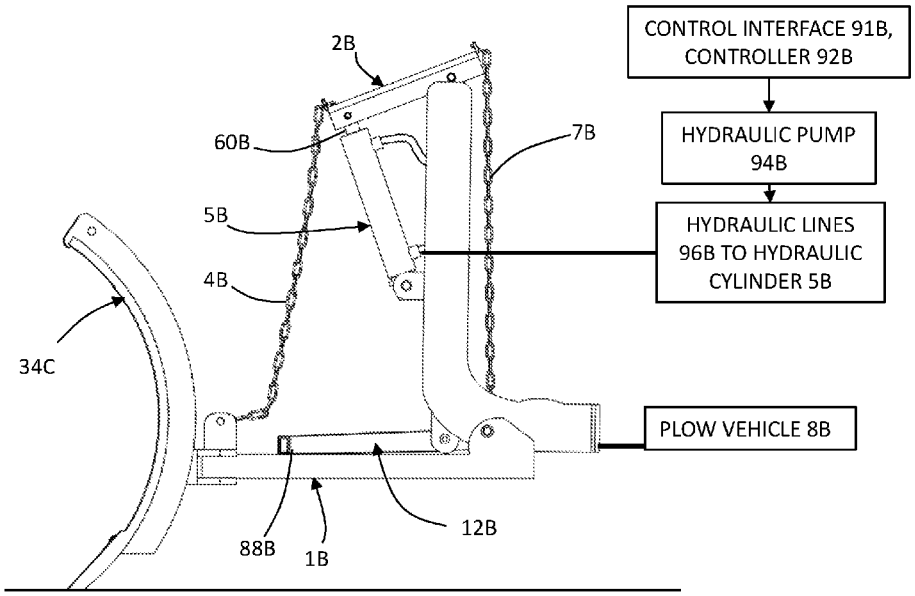
FIG. 24 is a side view of one embodiment of a plow lift and down pressure system wherein a down pressure arm is rigid.

In an alternative embodiment, a spring portion of a down pressure arm is eliminated and an entire down pressure arm is substantially rigid although the operation is similar. As illustrated in FIG. 24 for example, down pressure arm 12B is in the form of a metal bar or tube. In a method of operation, a user activates a control interface 91B inside a plow vehicle causing controller 92B to effect a hydraulic pump to act on first hydraulic cylinder 5B. This action consequentially actively draws push arm 60B into first hydraulic cylinder 5B. As described previously, down pressure tension line 7B tightens rotating down pressure arm 12B to apply a downward force through pusher 88B against push frame 1B. In preferred embodiments, sensors or other monitoring devices are used in conjunction with the rigid down pressure arm 12B to monitor ground level or hydraulic pressure changes thereby causing a release of hydraulic pressure if forces within the system reach a predetermined limit to avoid plastic deformation of any portion of the system. In yet another alternative embodiment (not shown), a spring element, such as a coiled spring is mounted between push frame 1B and pusher 88B to provide similar spring loading capabilities as described previously using a leaf spring.

Figure 25:
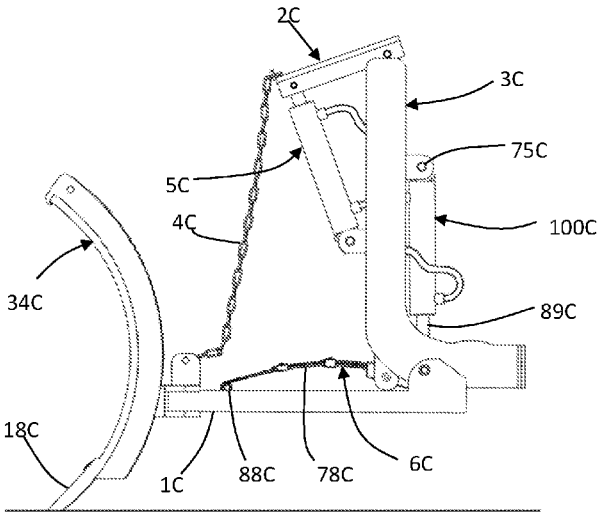
FIG. 25 is a side view of one embodiment of a plow lift and down pressure system comprising cooperating first and second hydraulic cylinders for lifting a plow and creating a plow down pressure.
Figure 25A:
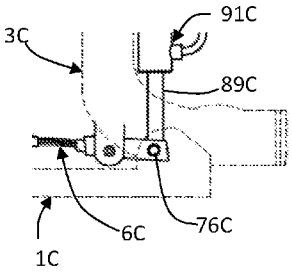
FIG. 25A is a partial side view of the embodiment of FIG. 25 of with select parts made transparent for viewing the interconnection between a secondary push arm and a down pressure arm.

In yet another alternative embodiment, an eighth lift pivot 75C extends from lift frame 3C. Illustrated in FIG. 25 is one embodiment wherein an eighth lift pivot 75C is located to the rear of lift frame 3C. A secondary hydraulic cylinder 100C is pivotably mounted between eighth lift pivot 75C and second down pressure receiver 76C located at a rear end of down pressure arm 6C (see FIG. 25A where select parts are transparent for viewing). In this embodiment, second down pressure receiver 76C is in the form of a pivot hole whereby a secondary push arm of secondary hydraulic cylinder 100C is pinned. Activating down pressure control on a control interface 91C in the cab of a plow vehicle 8C effectuates hydraulic pump 94C to cause secondary push arm 89C to actively recede into secondary hydraulic cylinder 100C. Second down pressure receiver 76C is consequentially driven upwards causing loading of spring portion 78C of down pressure arm 6C. This loading force produces downward loading on the plow as the force is again transmitted through a pusher 88C, through push frame 1C, and into plow 34C and plow blade 18C. Secondary hydraulic cylinder 100C may also be in the form of a double acting cylinder. The second direction is utilized to unload spring portion 78C and effectively store down pressure arm 6C away from push frame 1C. Alternatively, secondary hydraulic cylinder 100C may be substituted with a servomotor or linear actuator (not shown). In another alternative embodiment, down pressure tension lines 7A are replaced by a substantially rigid link such as a steel bar.

In another embodiment, a down pressure arm is rigid and the down pressure tension line is replaced by a resilient element such as a spring, or replaced by a combination element having both a rigid and spring portion. The spring portion may be constant or variable spring rate. In this configuration, a plow following a rise or dip in the contour of the ground is able to react to these changes without the use of a ground monitoring device or other sensors.

The foregoing invention has been described in accordance with the relevant legal standards, thus the description is exemplary rather than limiting in nature. Variations and modifications to the disclosed embodiment may become apparent to those skilled in the art and fall within the scope of the invention.

The invention claimed is:

1. A plow lift and down pressure system comprising:
a lift frame;
said lift frame comprising a mount end for securing to a front end of a plow vehicle;
said lift frame comprising a lift end opposing said mount end;
said lift end positioned superiorly of said mount end;
a first lift pivot positioned at said lift end of said lift frame;
a lever beam;
a plow for pushing natural materials;
a lift tension line;
a down pressure tension line;
a hydraulic pump;
said plow coupled with a plow receiver for receiving a lift tension line;
a push frame;
said push frame extending between said plow and said lift frame;
said push frame coupled to said plow;
said push frame pivotably coupled to said lift frame;

said lever beam comprising a lift receiver and a first down pressure receiver at opposed ends of said lever beam for securing tension lines thereon;

a second lift pivot positioned between said lift receiver and first down pressure receiver on said lever beam;

said second lift pivot pivotably coupled with said first lift pivot at said lift end of said lift frame;

said lift tension line coupled at a first end to said lift receiver of said lever beam;

said lift tension line coupled at a second end to said plow receiver;

one end of said down pressure tension line coupled to said first down pressure receiver of said lever beam;

a down pressure arm;

said down pressure arm having a trailing end and a forward end;

a second down pressure receiver fixed to said down pressure arm at said trailing end;

one end of said down pressure tension line coupled to said second down pressure receiver;

said forward end of said down pressure arm coupled with said push frame for application of downward force;

a first hydraulic cylinder for application of lift and down pressure forces to said plow;

one end of said first hydraulic cylinder pivotably fixed to a forward end of said lever beam;

an opposed end of said first hydraulic cylinder pivotably fixed to a fourth lift pivot on said lift frame;

said first hydraulic cylinder actively extending and retracting in response to changes in fluid pressure by said hydraulic pump;

wherein active retraction of said first hydraulic cylinder causes a consequent tension in said down pressure tension line and plow down pressure.

2. The plow lift and down pressure system of claim 1 wherein active extension of said first hydraulic cylinder causes a consequent lifting of an associated plow.

3. The plow lift and down pressure system of claim 1 wherein said down pressure arm comprises a spring portion for biasing said push frame and said plow downward against a surface to be plowed.

4. The plow lift and down pressure system of claim 3 wherein said spring portion is in the form of a leaf spring.

5. The plow lift and down pressure system of claim 1 wherein a mount end of said lift frame is configured to be releasably secured to a plow vehicle.

6. The plow lift and down pressure system of claim 1 wherein said hydraulic pump provides hydraulic pressure to said first hydraulic cylinder.

7. The plow lift and down pressure system of claim 6 further comprising a control interface operated by a user inside a plow vehicle.

8. The plow lift and down pressure system of claim 7 wherein said control interface is electrically coupled with a controller for activation of said hydraulic pump.

9. The plow lift and down pressure system of claim 1 wherein in said lift tension line and said down pressure tension line are chains.

10. The plow lift and down pressure system of claim 1 further comprising a parking leg extending from a portion of said down pressure arm for supporting the plow lift and down pressure system when removed from a plow vehicle.

11. A plow lift and down pressure system comprising:

a lift frame;

said lift frame comprising a mount end for securing to a front end of a plow vehicle;

said lift frame comprising a lift end opposing said mount end;

said lift end positioned superiorly of said mount end;

a first lift pivot positioned at said lift end of said lift frame;

a lever beam;

a plow for pushing natural materials;

a lift tension line;

a down pressure tension line;

a hydraulic pump;

said plow coupled with a plow receiver for receiving a lift tension line;

a push frame;

said push frame extending between said plow and said lift frame;

said push frame coupled to said plow;

said push frame pivotably coupled to said lift frame;

said lever beam comprising a lift receiver and a first down pressure receiver at opposed ends of said lever beam for securing tension lines thereon;

a second lift pivot positioned between said lift receiver and said first down pressure receiver on said lever beam;

said second lift pivot pivotably coupled with said first lift pivot at said lift end of said lift frame;

said lift tension line coupled at a first end to said lift receiver of said lever beam;

said lift tension line coupled at a second end to said plow receiver;

one end of said down pressure tension line coupled to said first down pressure receiver of said lever beam;

a down pressure arm;

said down pressure arm having a trailing end and a forward end;

a second down pressure receiver fixed to said down pressure arm at said trailing end;

one end of said down pressure tension line coupled to said second down pressure receiver;

said forward end of said down pressure arm coupled with said push frame;

a first hydraulic cylinder for application of lift and down pressure forces to said plow;

one end of said first hydraulic cylinder pivotably fixed to a forward end of said lever beam;

an opposed end of said first hydraulic cylinder pivotably fixed to a fourth lift pivot on said lift frame;

wherein said lift tension line is tensioned during lifting of said plow;

and wherein said down pressure tension line is tensioned during down pressure of said plow.

12. The plow lift and down pressure system of claim 11 wherein active extension of said first hydraulic cylinder causes a consequent lifting of said plow.

13. The plow lift and down pressure system of claim 11 wherein said down pressure arm comprises a spring portion for biasing said push frame and said plow downward against a surface to be plowed.

14. The plow lift and down pressure system of claim 11 wherein a down pressure mode said down pressure tension line is taught.

15. The plow lift and down pressure system of claim 11 wherein said second lift pivot on said lever beam is positioned closer to a rear end of said lever beam than a forward end of said lever beam.

16. The plow lift and down pressure system of claim 11 wherein said hydraulic pump provides hydraulic pressure to said first hydraulic cylinder.

17. The plow lift and down pressure system of claim 16 further comprising a control interface operated by a user inside a plow vehicle.

18. The plow lift and down pressure system of claim 17 wherein said control interface is electrically coupled with a controller for activation of said hydraulic pump.

19. The plow lift and down pressure system of claim 11 wherein in said lift tension line and said down pressure tension line are chains.

20. The plow lift and down pressure system of claim 11 further comprising a parking leg extending from a portion of said down pressure arm for supporting the plow lift and down pressure system when removed from a plow vehicle.

* * * * *